US009419347B2

(12) United States Patent
Xue et al.

(10) Patent No.: US 9,419,347 B2
(45) Date of Patent: Aug. 16, 2016

(54) CIRCULARLY POLARIZED ANTENNA

(71) Applicant: City University of Hong Kong, Kowloon (HK)

(72) Inventors: Quan Xue, Tai Po (HK); Shaowei Liao, Fanling (HK); Peng Wu, Kowloon (HK)

(73) Assignee: CITY UNIVERSITY OF HONG KONG, Kowloon (HK)

( * ) Notice: Subject to any disclaimer, the term of this patent is extended or adjusted under 35 U.S.C. 154(b) by 260 days.

(21) Appl. No.: 14/287,575

(22) Filed: May 27, 2014

(65) Prior Publication Data

US 2015/0349435 A1 Dec. 3, 2015

(51) Int. Cl.
*H01Q 21/29* (2006.01)

(52) U.S. Cl.
CPC ..... *H01Q 21/29* (2013.01)

(58) Field of Classification Search
CPC ..... H01Q 21/29
USPC ..... 343/725–728
See application file for complete search history.

(56) References Cited

U.S. PATENT DOCUMENTS 2,953,782 A * 9/1960 Byatt ..... G01S 1/02 342/428
3,576,567 A * 4/1971 Shively ..... H01Q 21/29 343/704
5,703,601 A 12/1997 Nalbandian et al.
6,437,750 B1 * 8/2002 Grimes ..... H01Q 7/00 343/726
7,362,272 B2 4/2008 Chang et al.
7,382,320 B2 6/2008 Chang et al.
7,528,781 B2 5/2009 Lin et al.
8,326,249 B2 * 12/2012 Cezanne ..... H01Q 1/24 455/269
8,339,327 B2 12/2012 Schadler et al.

OTHER PUBLICATIONS

D. Yang, H. Yang, J. Zhang, and Y. Li, "A Novel Circularly Polarized Bowtie Antenna for Inmarsat Communications,"IEEE Antennas and Propagation Magazine, vol. 54, No. 4, pp. 317-325, Aug. 2012.

X. Tang, H. Wong, Y. Long, Q. Xueand K. Lau, "Circularly Polarized Shorted Patch Antenna on High Permittivity Substrate With Wideband," IEEE Trans. Antennas Propag., vol. 60, No. 3, pp. 1588-1592, Mar. 2012.

T. Chang, J. Lin, Y. Chen, "A Circularly Polarized Ring-Antenna Fed by a Serially Coupled Square Slot-Ring," IEEE Trans. Antennas Propag., vol. 60, No. 2, pp. 1132-1135, Feb. 2012.

G. Fu, Z. Zhang, S. Zuo and Juan Lei, "A Wideband Circularly Polarized Antenna With T-Shaped Feed," Microwave and Optical Technology Letters, vol. 54, No. 1, pp. 153-156, Jap. 2012.

X. Yang, Y. Yin, W. Hu, and S. Zuo, "Low-Profile, Small Circularly Polarized Inverted-L Antenna With Double-Folded Arms",IEEE Antenna and Wireless Propagation Letters, vol. 9, pp. 767-770, Sep. 2010.

(Continued)

*Primary Examiner* — Hoang V Nguyen
(74) *Attorney, Agent, or Firm* — Amin, Turocy & Watson, LLP

(57) ABSTRACT

A circularly polarized antenna exhibiting a high performance characteristic can be produced by utilizing a ground plane, a half-loop, and an electric dipole in a predetermined configuration. The circularly polarized antenna can provide benefits, such as wide axial ratio bandwidth, high gain, and simple structure, over other unidirectional circularly polarized antennas.

20 Claims, 8 Drawing Sheets

(56) References Cited

OTHER PUBLICATIONS

Z. Wu, and E. Yung, "Wideband Circularly Polarized Vertical Patch Antenna", IEEE Trans. Antennas Propag., vol. 56, No. 11, pp. 3420-3425, Nov. 2008.

Tong, et al., "Circularly Polarized U-Slot Antenna," IEEE Trans. Antennas Propag., vol. 55, No. 8, pp. 2382-2385, Aug. 2007. Retrieved on Aug. 28, 2014, 4 pages.

H. Wong, P. Lau, K. Mak, and K. Luk, "Small Circularly Polarised Folded Patch Antenna,"Electronics Letters, vol. 41, No. 25, pp. 2382-2385, Nov. 2005.

F. Chang, K. Wong, and T. Chou, "Low-Cost Broadband Circularly Polarized Patch Antenna", IEEE Trans. Antennas Propag., vol. 51, No. 10, pp. 3006-3009, Oct. 2003.

K. Lee and K. Luk, Microstrip PatchAntennas, London: Imperial College Press, 2011, pp. 431-484.

C.A. Balanis, Modern Antenna Handbook, New York: Wiley, 2008, pp. 30-31.

* cited by examiner

CIRCULARLY POLARIZED ANTENNA

TECHNICAL FIELD

This disclosure relates generally to circularly polarized antennas for numerous wireless applications, e.g., for high performance.

BACKGROUND

An antenna is an electrical device that converts electric power into radio waves, and/or vice versa. Antennas are usually used with, or provided as part of, a radio transmitter and/or radio receiver. They are used in systems such as radio broadcasting, television, radar, cell phones, satellite communications, etc. The polarization of an antenna refers to an orientation of an electric field of a radio wave with respect to the Earth's surface and is determined by the physical structure of the antenna and by its orientation, which is different from the antenna's directionality.

By convention, an antenna's polarization is understood to refer to the direction of the electric field. Two special cases are linear polarization and circular polarization. In linear polarization, the electric field of the radio wave oscillates back and forth along one direction. This can be affected by the mounting of the antenna, but usually the desired direction is either horizontal or vertical polarization. In circular polarization, the electric field and magnetic field of the radio wave rotates at the radio frequency circularly around the axis of propagation.

Although linear polarized antennas have a far-field electric-field vector that is confined to a plane along the electromagnetic wave propagation direction, the far-field electric-field vector of a circularly polarized antenna has a constant magnitude and changes in a rotary manner along the propagation direction. Therefore, circularly polarized antennas can reduce the loss caused by a misalignment between the transmitter and receiver antennas, and suppress multipath effects caused by buildings and the ground.

The above-described background relating to antennas for various wireless applications is merely intended to provide a contextual overview of antenna technology, and is not intended to be exhaustive. Other context regarding antennas may become further apparent upon review of the following detailed description.

SUMMARY

A simplified summary is provided herein to help enable a basic or general understanding of various aspects of exemplary, non-limiting embodiments that follow in the more detailed description and the accompanying drawings. This summary is not intended, however, as an extensive or exhaustive overview. Instead, the purpose of this summary is to present some concepts related to some exemplary non-limiting embodiments in simplified form as a prelude to more detailed descriptions of the various embodiments that follow in the disclosure.

Described herein are systems, methods, articles of manufacture, and other embodiments or implementations that can facilitate the use of high performance circularly polarized antennas. High performance circularly polarized antennas can be implemented in connection with any type of device with a connection to a communications network (a wireless communications network, the Internet, or the like), such as a mobile handset, a computer, a handheld device, or the like.

A variety of current unidirectional circularly polarized antennas on the market suffer from poor performance or complex structure. However, the embodiments of high performance circularly polarized antennas presented herein provide several advantages such as simple structures, wide axial ratio bandwidth, and high gain. The high performance circularly polarized antenna can also be compatible with standard printed circuit boards (PCB) and low temperature co-fired ceramic (LTCC) technologies at millimeter wave band.

In various embodiments, a geometry of the high performance circularly polarized antenna described herein can comprise a ground plane, a half-loop, and an electric dipole. The half-loop can be perpendicular to the ground plane. The top middle of the half-loop can be an open circuit with its two ends connected to the two ends of the electric dipole, respectively. The electric dipole can be parallel to the ground plane and also perpendicular to the half-loop plane. The height and length of the electric dipole can be about a quarter and half of the free space wavelength, respectively, if the antenna is in the free space. The antenna can be excited by a differential source at the gap (open circuit position) at the top middle of the half-loop (this corresponds to shunt feeding for the electric dipole and half-loop) or two grounded points of the half-loop (this corresponds to series feeding for the electric dipole and half-loop). Antennas that are not series-fed are shunt fed.

According to one embodiment, described herein is a method for creating a high performance circularly polarized antenna. The method can provide several advantages to the circularly polarized antennas such as wide axial ratio bandwidth and high gain.

According to yet another embodiment, described herein is an apparatus for facilitating signal transmission via radio waves. The apparatus comprises a simple structure and can produce wide axial ratio bandwidth and high gain.

Additionally, according to a further embodiment, described herein is an apparatus for facilitating signal transmission via radio waves. The apparatus comprises a simple structure and can produce wide axial ratio bandwidth and high gain.

These and other embodiments or implementations are described in more detail below with reference to the drawings.

BRIEF DESCRIPTION OF THE DRAWINGS

Non-limiting and non-exhaustive embodiments of the subject disclosure are described with reference to the following figures, wherein like reference numerals refer to like parts throughout the various views unless otherwise specified.

DETAILED DESCRIPTION

Figure 1:
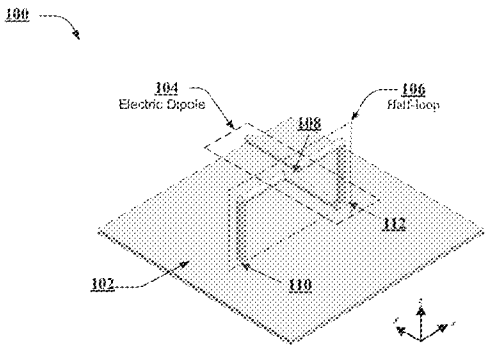
FIG. 1 illustrates a schematic of an example high performance circularly polarized antenna.

In the following description, numerous specific details are set forth to provide a thorough understanding of various embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment," or "an embodiment," means that a particular feature, structure, or characteristic described in connection with the embodiment is included in at least one embodiment. Thus, the appearances of the phrase "in one embodiment," "in one aspect," or "in an embodiment," in various places throughout this specification are not necessarily all referring to the same embodiment. Furthermore, the particular features, structures, or characteristics may be combined in any suitable manner in one or more embodiments.

As utilized herein, terms "component," "system," "interface," and the like are intended to refer to a computer-related entity, hardware, software (e.g., in execution), and/or firmware. For example, a component can be a processor, a process running on a processor, an object, an executable, a program, a storage device, and/or a computer. By way of illustration, an application running on a server and the server can be a component. One or more components can reside within a process, and a component can be localized on one computer and/or distributed between two or more computers.

Further, these components can execute from various computer readable media having various data structures stored thereon. The components can communicate via local and/or remote processes such as in accordance with a signal having one or more data packets (e.g., data from one component interacting with another component in a local system, distributed system, and/or across a network, e.g., the Internet, a local area network, a wide area network, etc. with other systems via the signal).

As another example, a component can be an apparatus with specific functionality provided by mechanical parts operated by electric or electronic circuitry; the electric or electronic circuitry can be operated by a software application or a firmware application executed by one or more processors; the one or more processors can be internal or external to the apparatus and can execute at least a part of the software or firmware application. As yet another example, a component can be an apparatus that provides specific functionality through electronic components without mechanical parts; the electronic components can include one or more processors therein to execute software and/or firmware that confer(s), at least in part, the functionality of the electronic components. In an aspect, a component can emulate an electronic component via a virtual machine, e.g., within a cloud computing system.

The words "exemplary" and/or "demonstrative" are used herein to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent exemplary structures and techniques known to those of ordinary skill in the art. Furthermore, to the extent that the terms "includes," "has," "contains," and other similar words are used in either the detailed description or the claims, such terms are intended to be inclusive—in a manner similar to the term "comprising" as an open transition word—without precluding any additional or other elements.

As used herein, the term "infer" or "inference" refers generally to the process of reasoning about, or inferring states of, the system, environment, user, and/or intent from a set of observations as captured via events and/or data. Captured data and events can include user data, device data, environment data, data from sensors, sensor data, application data, implicit data, explicit data, etc. Inference can be employed to identify a specific context or action, or can generate a probability distribution over states of interest based on a consideration of data and events, for example.

Inference can also refer to techniques employed for composing higher-level events from a set of events and/or data. Such inference results in the construction of new events or actions from a set of observed events and/or stored event data, whether the events are correlated in close temporal proximity, and whether the events and data come from one or several event and data sources. Various classification schemes and/or systems (e.g., support vector machines, neural networks, expert systems, Bayesian belief networks, fuzzy logic, and data fusion engines) can be employed in connection with performing automatic and/or inferred action in connection with the disclosed subject matter.

In addition, the disclosed subject matter can be implemented as a method, apparatus, or article of manufacture using standard programming and/or engineering techniques to produce software, firmware, hardware, or any combination thereof to control a computer to implement the disclosed subject matter. The term "article of manufacture" as used herein is intended to encompass a computer program accessible from any computer-readable device, computer-readable carrier, or computer-readable media. For example, computer-readable media can include, but are not limited to, a magnetic storage device, e.g., hard disk; floppy disk; magnetic strip(s); an optical disk (e.g., compact disk (CD), a digital video disc (DVD), a Blu-ray Disc™ (BD)); a smart card; a flash memory device (e.g., card, stick, key drive); and/or a virtual device that emulates a storage device and/or any of the above computer-readable media.

As an overview of the various embodiments presented herein, to correct for the above identified deficiencies and other drawbacks of linear polarized antennas, various embodiments are described herein to facilitate unidirectional circularly polarized antennas with a wide axial ratio bandwidth, high gain, and a simple structure.

Circularly polarized antennas can be omnidirectional or unidirectional. Unidirectional circularly polarized antennas have higher gain than omnidirectional circularly polarized antennas and thus are more suitable for some specific applications like long distance point-to-point wireless communication. Various unidirectional circularly polarized antennas have been widely applied to satellite communication systems, such as mobile satellites (MSAT) and global positioning systems (GPS).

Most of current unidirectional circularly polarized antenna designs suffer from either poor performance including narrow axial ratio (AR) bandwidth, low gain, or complex feeding and/or antenna structures, which greatly limit their practical applications. Therefore, unidirectional circularly polarized antennas with a wide AR bandwidth, high gain, and simple structure are highly desired.

FIGS. 1-10 illustrate methods that facilitate production of unidirectional circularly polarized antennas with a wide axial ratio bandwidth, high gain, and a simple structure. For simplicity of explanation, the methods (or algorithms) are depicted and described as a series of acts. It is to be understood and appreciated that the various embodiments are not limited by the acts illustrated and/or by the order of acts. For example, acts can occur in various orders and/or concurrently, and with other acts not presented or described herein. Furthermore, not all illustrated acts may be required to implement the methods. In addition, the methods could alternatively be represented as a series of interrelated states via a state diagram or events. Additionally, the methods described hereafter are capable of being stored on an article of manufacture (e.g., a computer readable storage medium) to facilitate transporting and transferring such methodologies to computers. The term article of manufacture, as used herein, is intended to encompass a computer program accessible from any computer-readable device, carrier, or media, including a non-transitory computer readable storage medium.

Referring now to FIG. 1, illustrated is a schematic of an example high performance circularly polarized antenna. The circularly polarized antenna 100 comprises a ground plane 102, an electric dipole 104, and a half-loop 106. The ground plane 102 can be a conducting surface large in comparison to a wavelength, which is connected to a transmitter's ground wire and serves as a reflecting surface for radio waves. The ground plane 102 reflector can be of multiple dimensions including but not limited to flat, corner, or spherical. The half-loop 106 can be perpendicular to the ground plane 102. The top middle of the half-loop 106 can be an open circuit where its two ends can be connected to the two ends of an electric dipole 104. The electric dipole 104 can be parallel to the ground plane 102 and also perpendicular to the half-loop 106 plane. The height and the length of the electric dipole 104 can be a quarter and a half of the free space wavelength if the antenna is in free space. The polarized antenna 100 can be excited by a differential source at the open circuit position 108 at the top middle of the half-loop 106. Excitement via shunt feeding for the electric dipole and half-loop can take place at the open circuit position 108 at the top middle of the half-loop 106. Excitement via series feeding for the electric dipole and half-loop can take place at the two grounded points of the half-loop 106. Switching the directions of the two arms of the electric dipole 104 can change the polarization of the antenna 100 between left-handed circular polarization (LHCP) and right-handed circular polarization (RHCP).

Figure 2:
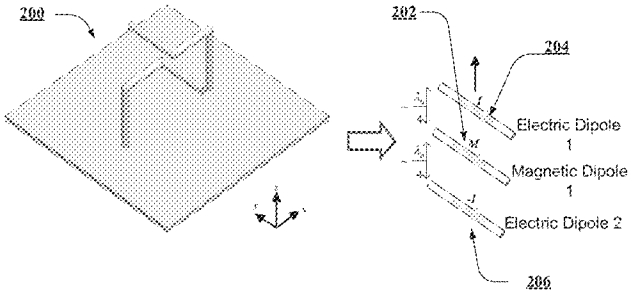
FIG. 2 illustrates a schematic of the equivalent current flow of an example high performance circularly polarized antenna.

Referring now to FIG. 2, illustrated is a schematic of the equivalent current flow of an example high performance circularly polarized antenna 200. This figure shows the working principle of the antenna. The circularly polarized antenna 200 can be equivalent to two electric dipoles 204 206 and one magnetic dipole 202. Electric dipole 206 is the image of electric dipole 204 with respect to the ground plane. As shown in FIG. 2, the two electric dipoles 204 206 and one magnetic dipole 202 can be in parallel with each other and can be a quarter wavelength ($\lambda_0/4$) in distance apart, where wavelength is represented by $\lambda_0$. Assuming the current is I along the first electric dipole 204 and thus the current is −I along the second electric dipole, the amplitude can be the same; however, the phase is opposite. Since the electric dipoles 204 206 are parallel to each other and a half wavelength apart $(\lambda_0/4)+(\lambda_0/4)=\lambda_0/2)$, the far-field electric field vector generated by the first electric dipole 204 can be enhanced in the z-direction. The half-loop and its image with respect to the ground plane can work together as the magnetic dipole 202 with magnetic current M along it, where M and I can be in phase. Due to the quarter wavelength distance between the magnetic dipole 202 and the first electric dipole 204, the far-field electric field vector in the z-direction is generated by the magnetic dipole 202 along the x-direction and is of a ninety-degree lag to the far-field electric field vector generated by the first electric dipole 204. By adjusting the amplitude of M and I, the overlap of the far-field vectors of the electric dipoles 204 206 and the magnetic dipole 202 can form a circularly polarized far-field vector in the z-direction.

Figure 3:
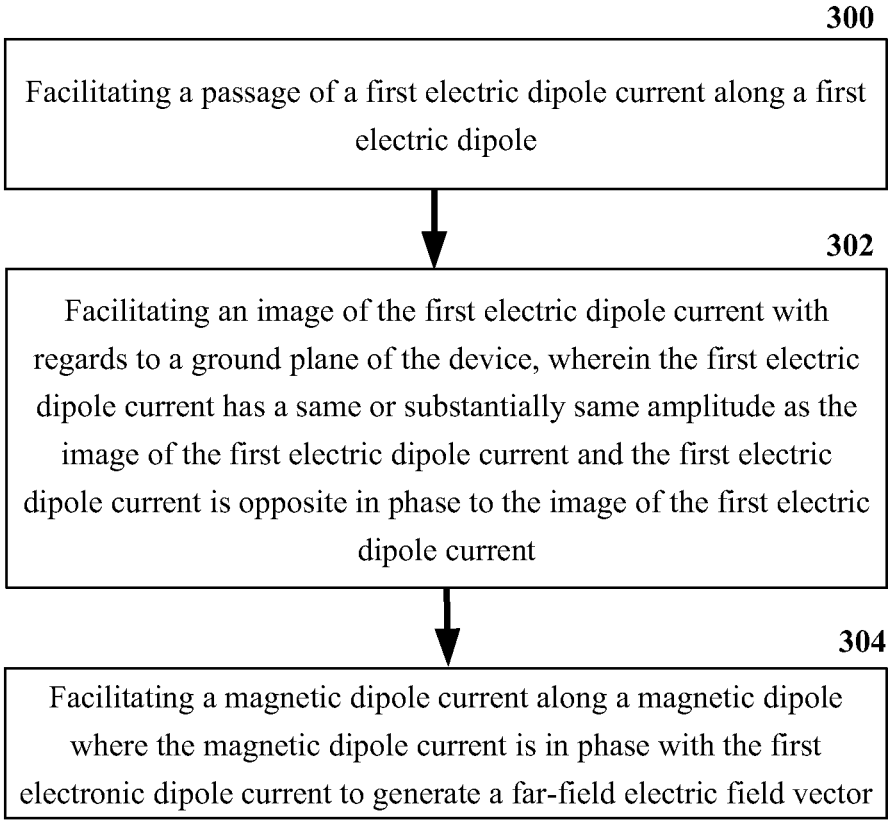
FIG. 3 illustrates a schematic process flow diagram of a method for facilitating the design of an example high performance circularly polarized antenna.

Referring now to FIG. 3, illustrated is a schematic process flow diagram of a method for facilitating the practical design of an example high performance circularly polarized antenna. Element 300 can facilitate a passage of a first electric dipole current I along a first electric dipole; and element 302 can facilitate an image of the first electric dipole current with regards to a ground plane, wherein the first electric dipole current has a same or substantially same amplitude as the image of the first electric dipole current and the first electric dipole current is opposite in phase to the image of the first electric dipole current. Element 304 can facilitate a magnetic dipole current M where the magnetic dipole current M is in phase with the first electric dipole current −I. The first electric dipole of element 300, the first electric dipole image of element 302, and the magnetic dipole of element 304 can be in parallel with each other. Since the electronic dipole of element 300 and the electric dipole image of element 302 are parallel to each other and a half wavelength apart $((\lambda_0/4)+(\lambda_0/4)=(\lambda_0/2)$, the far-field electric field vector generated by the first electric dipole of element 300 can be enhanced in the z-direction. The half-loop and its image can work together as the magnetic dipole of element 304 with magnetic current M along it, where M and I can be in phase. Due to the quarter wavelength distance between the magnetic dipole of element 304 and the first electric dipole of element 300, the far-field electric field vector in the z-direction is generated by the magnetic dipole 304 along the x-direction and is of a ninety-degree lag to the far-field electric field vector generated by the first electric dipole 300. By adjusting the amplitude of M and I, the overlap of the far-field vectors of the electric dipole of element 300, the electric dipole image of element 302 and the magnetic dipole of element 304 can form a circularly polarized far-field vector in the z-direction.

Figure 4:
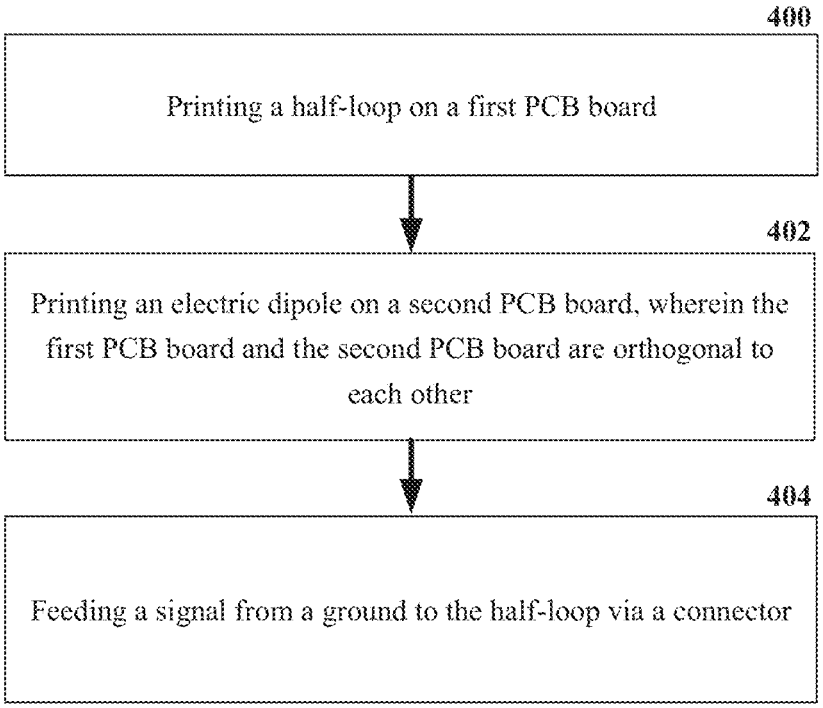
FIG. 4 illustrates a schematic process flow diagram of a method to produce a circularly polarized antenna.

Referring now to FIG. 4, illustrated is a schematic process flow diagram of a method to produce a circularly polarized antenna. The circularly polarized antenna can comprise a ground plane of element 404, a half-loop of element 400, and an electric dipole of element 402. The ground plane of element 404 can be a conducting surface large in comparison to a wavelength, which is connected to a transmitter's ground wire and serves as a reflecting surface for radio waves. The ground plane reflector of element 404 can be of multiple dimensions including but not limited to flat, corner, or spherical. The half-loop of element 400 can be perpendicular to the ground plane of element 404. The top middle of the half-loop of element 400 can be an open circuit where its two ends can be connected to the two ends of an electric dipole of element 402. The electric dipole of element 402 can be parallel to the ground plane of element 404 and also perpendicular to the half-loop plane of element 400. The height and the length of the electric dipole of element 402 can be a quarter and a half of the free space wavelength, respectively, if the antenna is in free space.

Element 400 can print a half-loop on a first printed circuit board (PCB). The half-loop of element 400 can be perpendicular to the ground plane of element 404. The top middle of the half-loop can be an open circuit where its two ends can be connected to the two ends of an electric dipole as referenced by element 402. The electric dipole of element 402 can be printed on a second PCB, wherein the PCB of element 400 and the PCB of element 402 are orthogonal to each other. The electric dipole can be parallel to the ground plane of element 404 and also perpendicular to the half-loop plane of element 400.

The polarized antenna can be excited by a differential source at the open circuit position at the top middle of the half-loop of element 400. Excitement via shunt feeding for the electric dipole and half-loop can take place at the open circuit position at the top middle of the half-loop of element 400. Excitement via series feeding for the electric dipole and half-loop can take place at the two grounded points of the half-loop of element 400. Switching the directions of the two arms of the electric dipole of element 402 can change the polarization of the antenna between left-handed circular polarization (LHCP) and right-handed circular polarization (RHCP).

Figure 5A:
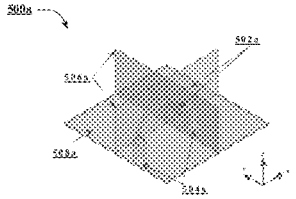
FIG. 5*a* illustrates a schematic of the practical design of an example high performance circularly polarized antenna.

Referring now to FIG. 5*a*, illustrated is a schematic of the practical design of an example high performance circularly polarized antenna. The circularly polarized antenna 500*a* of FIG. 5*a* can be comprised of a ground plane 508*a* and two copper layers 502*a* comprising a half-loop and a bowtie electric dipole etched on two PCB boards 506*a* respectively. A bowtie electric dipole is a wire approximation in two dimensions made of two roughly conical conductive objects, nearly touching at their points.

The ground plane 508*a* can be a conducting surface large in comparison to a wavelength, which is connected to a transmitter's ground wire and serves as a reflecting surface for radio waves. The ground plane 508*a* reflector can be of multiple dimensions including but not limited to flat, corner, or spherical. The half-loop of the copper layer 502*a* can be perpendicular to the ground plane 508*a*. The half-loop can also connect to the ground plane 508*a* via subminiature version A (SMA) connectors 504*a*. The top middle of the half-loop can be an open circuit where its two ends can be connected to the two ends of a bowtie electric dipole. The bowtie electric dipole can be parallel to the ground plane 508*a* and also perpendicular to the half-loop plane. The height and the length of the bowtie electric dipole can be a quarter and a half of the free space wavelength if the antenna is in free space. Excitement via series feeding for the bowtie electric dipole and half-loop can take place at the two grounded points of the half-loop. Switching the directions of the two arms of the bowtie electric dipole can change the polarization of the antenna 500*a* between left-handed circular polarization (LHCP) and right-handed circular polarization (RHCP).

Figure 5B:
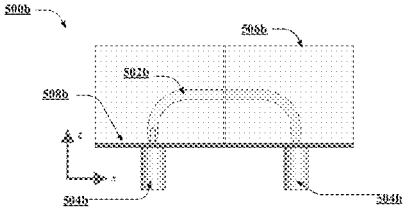
FIG. 5*b* illustrates a first side view schematic of the practical design of an example high performance circularly polarized antenna.

Referring now to FIG. 5*b*, illustrated is a first side view schematic of the practical design of an example high performance circularly polarized antenna 500*b*. The circularly polarized antenna 500*b* of FIG. 5*b* can be comprised of a ground plane 508*b*, a half-loop 502*b*, and a bowtie electric dipole (not shown from this view). The half-loop 502*b* and the bowtie electric dipole can be etched on two PCB boards 506*b*, respectively. The ground plane 508*b* can be a conducting surface large in comparison to a wavelength, which is connected to a transmitter's ground wire and serves as a reflecting surface for radio waves. The ground plane 508*b* reflector can be of multiple dimensions including but not limited to flat, corner, or spherical. The half-loop 502*b* of the copper layer can be perpendicular to the ground plane 508*b*. The half-loop can also connect to the ground plane 508*b* via subminiature version A (SMA) connectors 504*b*. The top middle of the half-loop 502*b* can be an open circuit where its two ends can be connected to the two ends of a bowtie electric dipole. The bowtie electric dipole can be parallel to the ground plane 508*a* and also perpendicular to the half-loop 502*b* plane. The height and the length of the bowtie electric dipole can be a quarter and a half of the free space wavelength if the antenna is in free space. Excitement via series feeding for the bowtie electric dipole and half-loop can take place at the two grounded points of the half-loop 502*b*. Switching the directions of the two arms of the bowtie electric dipole can change the polarization of the antenna 500*b* between left-handed circular polarization (LHCP) and right-handed circular polarization (RHCP).

Figure 5C:
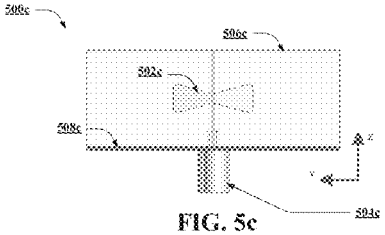
FIG. 5*c* illustrates a second side view schematic of the practical design of an example high performance circularly polarized antenna.

Referring now to FIG. 5*c*, illustrated is a second side view schematic of the practical design of an example high performance circularly polarized antenna 500*b*. The circularly polarized antenna 500*c* of FIG. 5*c* can be comprised of a ground plane 508*c*, a half-loop (not show in this view), and a bowtie electric dipole 502*c*. The half-loop 502*b* and the bowtie electric dipole can be etched on two PCB boards 506*b*, respectively. The ground plane 508*c* can be a conducting surface large in comparison to a wavelength, which is connected to a transmitter's ground wire and serves as a reflecting surface for radio waves. The ground plane 508*c* reflector can be of multiple dimensions including but not limited to flat, corner, or spherical. The half-loop of the copper layer can be perpendicular to the ground plane 508*c*. The half-loop can also connect to the ground plane 508*c* via subminiature version A (SMA) connectors 504*c*. The top middle of the half-loop can be an open circuit where its two ends can be connected to the two ends of a bowtie electric dipole 502*c*. The bowtie electric dipole 502*c* can be parallel to the ground plane 508*c* and also perpendicular to the half-loop plane. The height and the length of the bowtie electric dipole 502*c* can be a quarter and a half of the free space wavelength if the antenna is in free space. Excitement via series feeding for the bowtie electric dipole and half-loop can take place at the two grounded points of the half-loop. Switching the directions of the two arms of the bowtie electric dipole 502*c* can change the polarization of the antenna 500*c* between left-handed circular polarization (LHCP) and right-handed circular polarization (RHCP).

Figure 6:
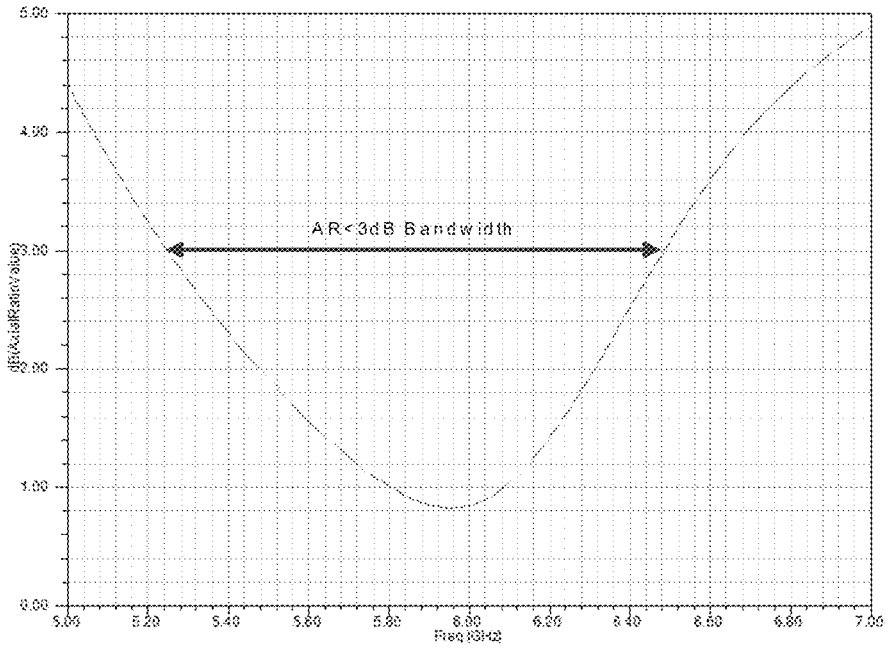
FIG. 6 illustrates a broadside axial ratio graph of a practical design of an example high performance circularly polarized antenna.

FIGS. 6-10 are graphic representation based on a practical design. In one embodiment a practical design can have a center working frequency at 5.8 GHz. The half-loop and bowtie electric dipole can be printed on two orthogonal PCB boards, and can have a differential signal fed via two holes on the ground to the half-loop. Series feeding for the electric dipole and half-loop can be adopted in this specific design. The whole structure can be 180° rotationally symmetrical. FIG. 6 depicts the broadside (radiation in the z-direction) axial ratio (AR) where AR<3 dB has a bandwidth from 5.25 to 6.50 GHz or 21.3%. The axial ratio is the ratio of orthogonal components of an electric field. A circularly polarized field can be made up of two orthogonal electric field components of equal amplitude and ninety degrees out of phase. The ratio of the larger component to the smaller component is termed as the axial ratio (AR). In an ideal case, where the components are of equal magnitude, the axial ratio is 1 (or 0 dB). In reality, it is impossible for a circularly polarized antenna to achieve a perfect circular polarization (AR=0 dB) within a whole frequency band. Usually axial ratio is required to be below 3 dB and the corresponding frequency range is called the 3-dB axial ratio bandwidth of the antenna.

Figure 7:
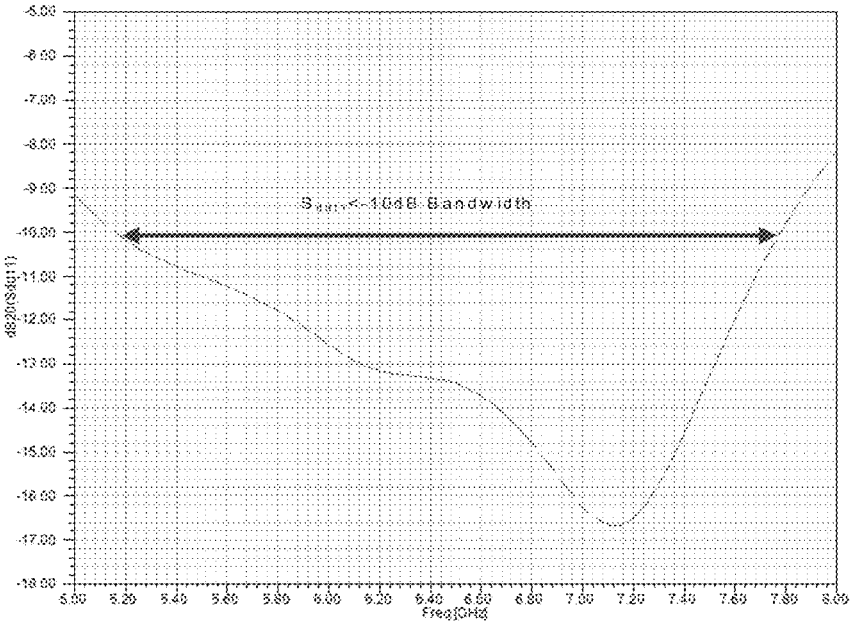
FIG. 7 illustrates a differential reflection coefficient graph of a practical design of an example high performance circularly polarized antenna.

The differential reflection coefficient ($S_{dd}$11) depicted in FIG. 7 where $S_{dd}$11←10 dB yields a −10 dB impedance bandwidth from 5.16 to 7.78 GHz or 40.5%. The differential reflection coefficient describes wave return loss. A reflected power of 0 dB indicates one hundred percent of the power is reflected, whereas a reflected power of −10 dB indicates only ten percent of the power is reflected. For a circularly polarized antenna, the overall bandwidth is determined by the overlapped bandwidth of its AR and impedance bandwidth.

Figure 8:
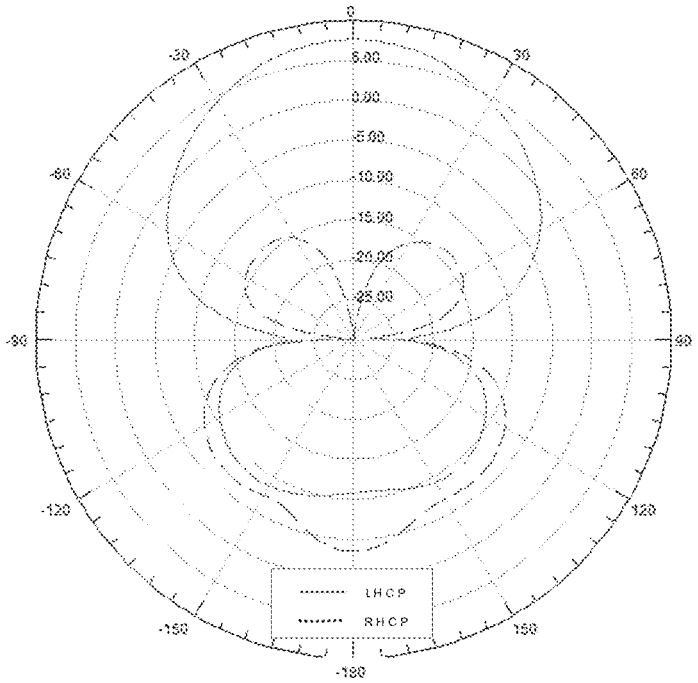
FIG. 8 illustrates an xz-plane radiation pattern graph of a practical design of an example high performance circularly polarized antenna.
Figure 9:
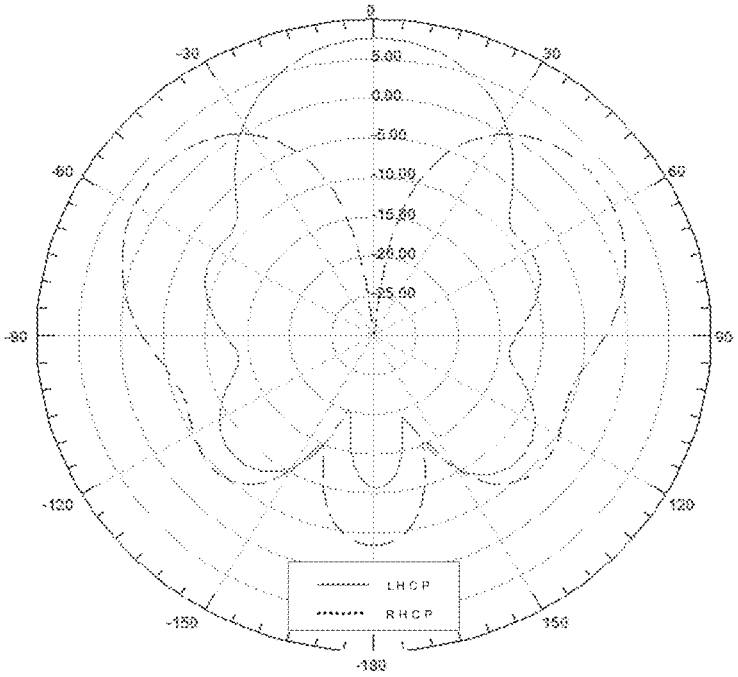
FIG. 9 illustrates a yz-plane radiation pattern graph of a practical design of an example high performance circularly polarized antenna.
Figure 10:
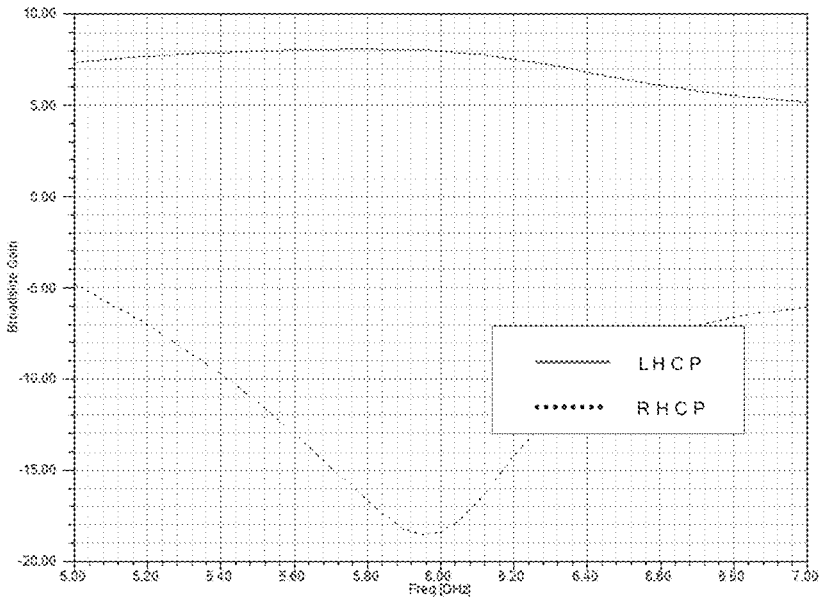
FIG. 10 illustrates a broadside gain of a practical design of an example high performance circularly polarized antenna.

Radiation pattern refers to the directional (angular) dependence of the strength of the radio waves from the antenna. For instance, omnidirectional radiation patterns radiate equal power in all directions perpendicular to the antenna. The power varies from the angle to the axis and drops to zero on the antenna's axis. This illustrates the general principle that if the shape of an antenna is symmetrical, its radiation pattern will have the same symmetry. Therefore, the radiation patterns at the XZ-plane and YZ-plane at 5.8 GHz are given in FIGS. 8 and 9. FIGS. 8 and 9 show that the antenna is LHCP and the radiation pattern is symmetric. The broadside gain, also known as a power gain, is represented by FIG. 10. FIG. 10 shows an optimal power gain between 7 dBi-8 dBi within its axial ratio bandwidth ranging from 5.25 to 6.50 GHz.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the subject matter has been described herein in connection with various embodiments and corresponding FIGs, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

What is claimed is:

1. An apparatus, comprising:

a half-loop of a half-loop plane perpendicularly connected to a ground of a ground plane, wherein the half-loop comprises an open circuit comprising a first half-loop end and a second half-loop end; and an electric dipole situated parallel to the ground plane and situated perpendicularly to the half-loop plane, wherein the first half-loop end connects to a first end of the electric dipole and the second half-loop end connects to a second end of the electric dipole.

2. The apparatus of claim 1, wherein the electric dipole comprises a length of about a half of a free space wavelength.

3. The apparatus of claim 1, wherein the electric dipole comprises a height of about a quarter of a free space wavelength.

4. The apparatus of claim 1, wherein the electric dipole is a bowtie electric dipole arranged in a bowtie configuration.

5. The apparatus of claim 1, wherein the half-loop comprises a semi-circular shape.

6. The apparatus of claim 1, wherein the half-loop comprises a rectangular shape.

7. The apparatus of claim 1, wherein the ground is flat or substantially flat.

8. The apparatus of claim 1, wherein the ground comprises a corner reflector.

9. The apparatus of claim 1, wherein the half-loop and electric dipole are shunt fed.

10. The apparatus of claim 1, wherein the half-loop and electric dipole are series fed.

11. A method, comprising:

facilitating a first electric dipole current along a first electric dipole of a device;

facilitating an image of the first electric dipole current with regards to a ground plane of the device, wherein the first electric dipole current has a same or substantially same amplitude as the image of the first electric dipole current and the first electric dipole current is opposite in phase to the image of the first electric dipole current; and facilitating a magnetic dipole current along a magnetic dipole of the device, wherein the magnetic dipole current is in phase with the first electric dipole current to generate a far-field electric vector.

12. The method of claim 11, further comprising:

adjusting the same or substantially same amplitude of the first electric dipole current and the second electric dipole current; and adjusting another amplitude of the magnetic dipole current.

13. The method of claim 11, further comprising:

reversing respective directions of the first electric dipole to change a polarization of an antenna.

14. The apparatus of claim 11, wherein the electric dipole comprises a length of about a half of a free space wavelength.

15. The apparatus of claim 11, wherein the electric dipole comprises a height of about a quarter of a free space wavelength.

16. An apparatus, comprising:

a half-loop printed on a first printed circuit board (PCB);

an electric dipole printed on a second PCB, wherein the first PCB and the second PCB are arranged orthogonally to each other;

a connector configured to receive a signal from a ground of the apparatus for routing to the half-loop.

17. The apparatus of claim 16, wherein the connector further comprises a coaxial radio frequency connector.

18. The apparatus of claim 16, wherein the electric dipole further comprises a copper layer.

19. The apparatus of claim 16, wherein the half-loop comprises a rectangular shape and the electric dipole further comprises a copper layer.

20. The apparatus of claim 16, wherein the half-loop comprises a semi-circular shape and the electric dipole is series fed.

* * * * *